US005676439A

United States Patent [19]

Occhipinti et al.

[11] Patent Number: 5,676,439

[45] Date of Patent: Oct. 14, 1997

[54] FILE MARKER

[75] Inventors: Vincent Occhipinti, LaGrange Park; Peter Occhipinti, Itasca; Salvatore Occhipinti, Elgin, all of Ill.

[73] Assignee: A.I.P. Products, Inc., Elgin, Ill.

[21] Appl. No.: 587,141

[22] Filed: Jan. 16, 1996

[51] Int. Cl.[6] ..... B42F 17/00

[52] U.S. Cl. ..... 312/183; 40/666; 40/308; 312/187; 312/193.4

[58] Field of Search ..... 312/183, 184, 312/187, 193.4, 348.3, 348.5; 40/666, 308, 316

[56] References Cited

U.S. PATENT DOCUMENTS

D. 231,714 5/1974 Arthur .
D. 307,441 4/1990 Robertson, Jr. .
D. 331,598 12/1992 Martin .
1,932,935 10/1933 Hubbard .
3,090,347 5/1963 Harnett, Jr. .
4,218,838 8/1980 Zippel .
4,550,934 11/1985 Goossen .
5,160,296 11/1992 Katz .
5,312,177 5/1994 Coulter .

*Primary Examiner*—Peter M. Cuomo
*Assistant Examiner*—Stephen Vu
*Attorney, Agent, or Firm*—Hill, Steadman & Simpson

[57] ABSTRACT

A file marker for marking the position of material removed from a file drawer or similar receptacle is disclosed. The file marker comprises a relatively flat body portion having a body side edge, a depending leg portion having a leg edge in spaced parallel relation to the body side edge, and an intermediate portion extending between and connecting the body portion and leg portion. The leg edge and body side edge define a gap therebetween sized to receive a rail of a suspension file drawer which permits positioning of the body portion within the file drawer contents. The file marker is also usable within a conventional address/telephone card file in a horizontal position. A kit of color-coded file markers is also disclosed.

38 Claims, 2 Drawing Sheets

FIG.1
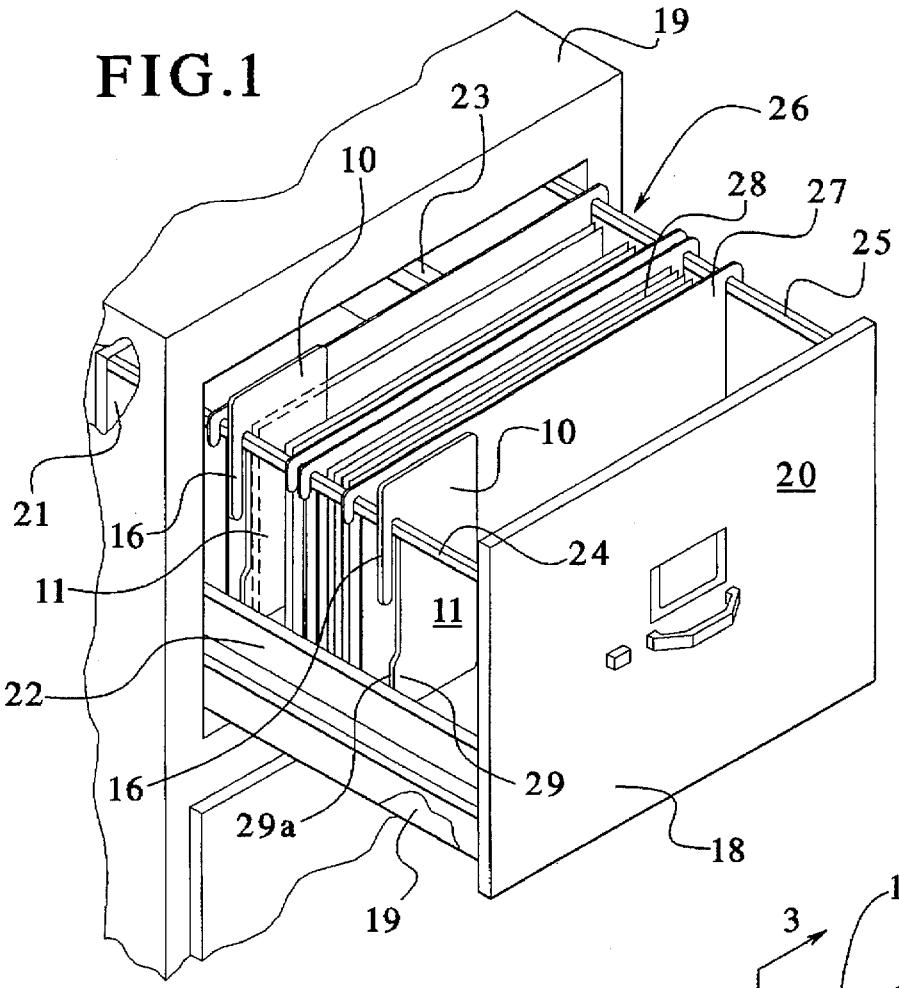
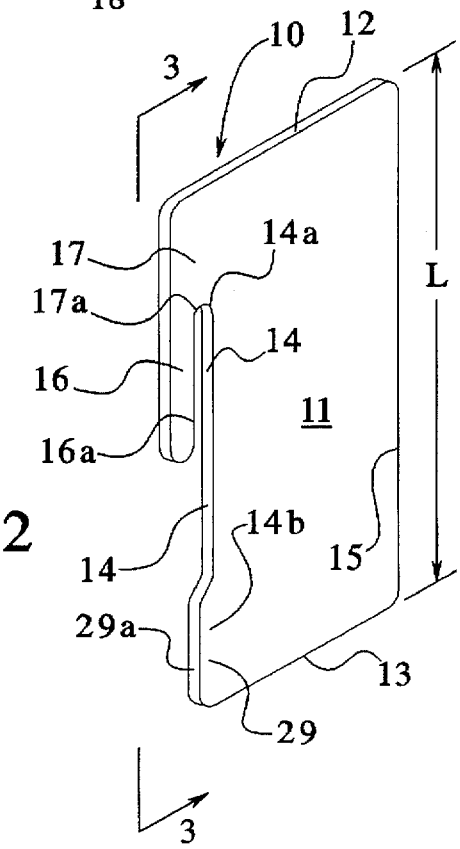
FIG.2

FILE MARKER

BACKGROUND AND SUMMARY

This invention relates to filing systems and more particularly to devices for marking positions where material has been removed from within a file drawer or similar receptacle.

Many different methods are commonly used to mark the position of material removed from a file. One such method is to insert a self-stick note, such as sold under the trademark Post-It by 3M, in the position within the file where material has been removed. However, such notes tend to fall off over time and have somewhat of a sloppy appearance. Another commonly used method is to lift a portion of the file contents, such as a sheet of paper, upwards so that it sticks out of the general file contents and marks the position of the removed material. However, the displaced material generally has a sloppy and disorganized appearance as well as sometimes creating problems with opening and closing the file drawer.

A combined file marker and measuring instrument has been proposed in Martin design patent No. 331,598. The file marker includes two legs attached to the top of a ruler for defining V-shaped grooves which grip the leading edge of a hanging file folder. However, positioning of the file marker is limited to the leading edges of hanging file folders which have a steel rod running therethrough and can support the weight of the file marker. In contrast, individual sheets of paper and the like do not have the strength to support the file markers and it is believed that the file marker would be ineffective for marking positions within the contents of the file folders.

An important aspect of this invention therefore lies in providing a file marker which is capable of infinite adjustment throughout file contents and can be positioned at any selected point along the file drawer, regardless of whether it is used to separate entire files or individual sheets of paper. Such results are achieved by providing a file marker having a body portion and means extending from the body portion for engaging the rail of a suspension file drawer and permitting infinite positioning of the file marker within the contents of the file.

In one embodiment, the means for engaging the file rail comprises a depending leg portion and an intermediate portion extending between and connecting the body portion and leg portion. The leg portion has a leg edge in spaced parallel relation to a body side edge of the body portion, and the parallel edges define a gap therebetween sized to receive the rail of a suspension file drawer. A projection member is provided on an end of the body portion opposite from the leg for engaging the inside of the side panel of the file drawer and maintaining the file marker in a level orientation. The length of the file marker should be such that it engages both the rail and side panel and such length is also advantageous in that it fits within a standard 3 by 5 address/telephone card file in a horizontal orientation. The file marker therefore can serve the dual functions of being used as a file marker within a suspension file drawer and within a standard 3 by 5 address/telephone card file.

Another advantageous aspect lies in providing a kit of color-coded file markers. The color-coded file markers can be used to mark the position of files removed by different people so that the color of the file marker serves as an indicating means of who removed a file from a drawer.

Other advantages, objects, and features of the invention will become apparent from the following drawings and specification.

BRIEF DESCRIPTION OF THE DRAWINGS

FIG. 1 is a perspective view of the file marker embodying this invention in combination with a suspension file drawer.

FIG. 2 is a perspective view of the file marker embodying the present invention.

DETAILED DESCRIPTION OF PREFERRED EMBODIMENT

Figure 4:
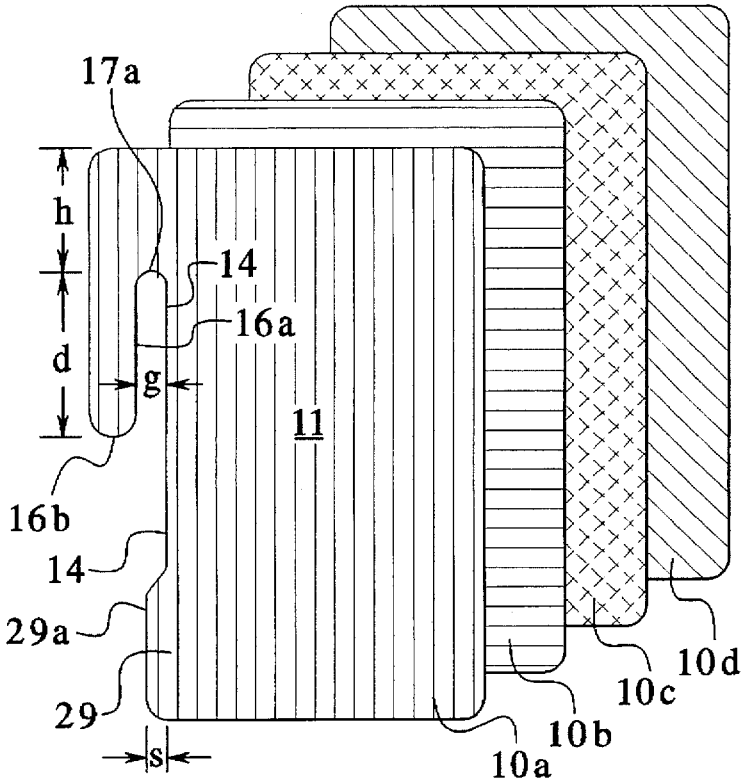
FIG. 4 is a front elevational view of a kit of color-coded colored file markers embodying this invention.
Figure 3:
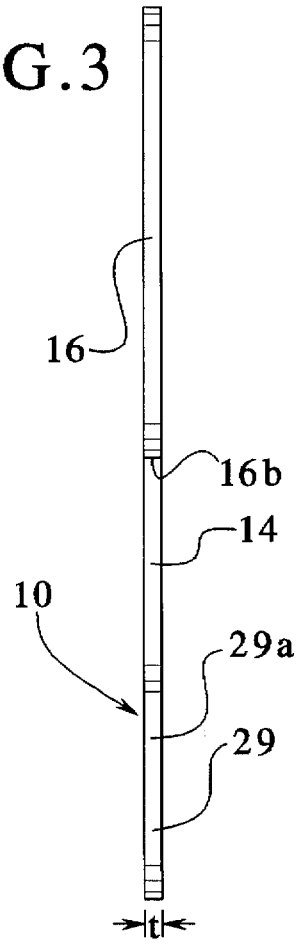
FIG. 3 is a side elevational view of the file marker embodying this invention.

Referring to the drawings, the numeral 10 generally designates the file marker of this invention. File marker 10 includes a body portion 11 shown in the form of a relatively flat rectangular panel having generally rounded or radius corners. However, it will be understood that the configuration and size of the body portion 11 may vary considerably depending upon the particular use for which it is intended.

Referring to FIG. 2, body portion 11 includes top and bottom edges 12 and 13 and body side edges 14 and 15. One of the body side edges is provided with means for engaging the rail of a suspension file drawer and allowing infinite positioning of the file marker along the rail and within the contents of the file drawer.

In the embodiment given in the illustrations, the engaging means includes leg portion 16 and intermediate portion 17 which extends between and connects body portion 11 and leg portion 16. Leg portion 16 and intermediate portion 17 are positioned adjacent to a first end portion **14*a* of body side edge 14 but may be provided on either side or end of body portion 11. Leg portion 16 has a leg edge 16*a* in spaced parallel relation to body side edge 14, and the parallel edges define a gap g therebetween which is sized to receive a rail of a suspension file drawer. The width of gap g between edges 16*a* and 14** should be about 0.125 to 0.3125 inches, preferably about 0.21875 inches, for accommodating most types of file rails.

Referring to FIG. 1, file markers 10 are shown in combination with a suspension file drawer 18 positioned within file cabinet 19. File drawer 18 includes a bottom 19, a front panel 20, a back panel 21, two side panels 22 and 23, and first and second parallel rails 24 and 25 extending between the front and back panels 20 and 21 of the file drawer. Rails 24 and 25 are spaced above the top edges of side panels 22 and 23. Such a suspension file drawer 18 is conventional.

File contents generally designated at 26 are disposed in file drawer 18 and generally include hanging file folders 27 and sheets of paper 28 disposed within file folders 27. Since file markers 10 have means for engaging rails 24 and 25 and can be infinitely positioned along the length of file drawer 18, the markers can readily be placed between file folders 27 or between individual sheets of paper 28, as shown. The file markers are capable of such positioning because its positioning is not dictated by the file contents.

Referring to FIGS. 1, 2 and 4, file markers 10 are supported on rail 24 by a rounded or arcuate stop edge **17*a* of intermediate portion 17 which extends between leg edge 16*a* and body side edge 14. Stop edge 17*a* is rounded to generally conform to the rounded top edge of conventional file rails and to allow easy sliding of the file markers therealong. The height between stop edge 17*a* and top edge 12 of body portion 11 is important so that it will not hinder opening and closing of the file drawer, and the height h should be between about 0.75 and 1.25 inches, preferably about 1 inch. The distance between stop edge 17***a* and terminal end 16*b* of leg portion 16 is also important so that the leg will have sufficient length to adequately grip the file rails and will not easily become dislodged. Distance d between the stop edge and the end of leg 16 should be about 0.5 to 2 inches, preferably about 1.5 inches, to adequately grip the file rails. An elongate projection 29 extends outwardly from second end portion 14*b* of body side edge 14 and has a projection edge 29*a* parallel to body side edge 14 and leg edge 16*a*. Referring to FIG. 1, projection edge 29*a* engages the inside of side panel 22 of file drawer 18 so that the top edge 14 of body portion 11 maintains a horizontal orientation; otherwise, if body portion 11 were allowed to tip, one of the corners of top edge 12 might project upward and hinder opening and closing of file drawer 18. In one embodiment in which gap g had a width of approximately 0.21875 inches, projection edge 29*a* extended beyond body side edge 14 a spacing s of about 0.125 inches to ensure a level orientation of the top edge 12 of the file marker.

The length l of body portion 11 between top edge 12 and bottom edge 13 should also be sufficiently long to ensure that the end portion 14*b* of body side edge 14 engages the inside of the side panels of the file drawer. To achieve such results, length l is preferably between about 4.75 and 5.125 inches. Such a dimension is also advantageous since the file marker can then also be used in a horizontal orientation in conventional 3 by 5 address/telephone card files.

Figure 5:
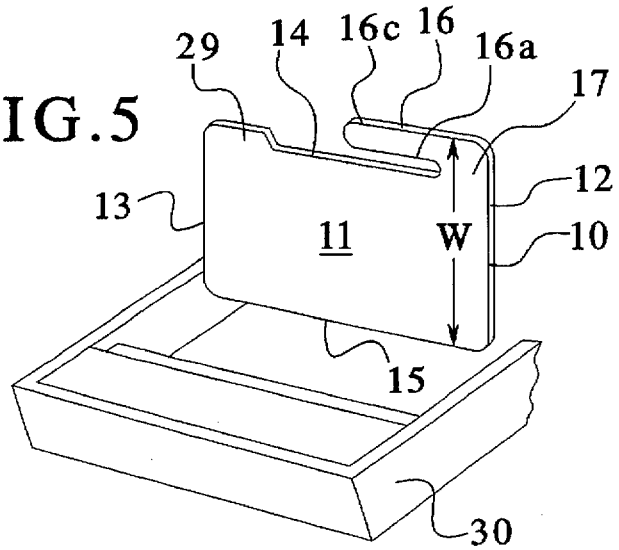
FIG. 5 is a perspective view of the inventive file marker in combination with an address/telephone card file.

Referring to FIG. 5, file marker 10 is shown in combination with an address/telephone card file 30, such as sold under the trademark ROLODEX®. As mentioned, the length of the file marker is preferably between 4.75 and 5.125 inches so that it will serve the dual functions of both a file marker for a suspension file drawer and as a marker for a conventional address/telephone card file 30. The width w of the file marker between edge 15 and 16*c* on leg 16 is preferably at least 3 inches, and is preferably about 3.375 inches, so that leg 16 will protrude outwards from the contents of a conventional 3 by 5 address/telephone file.

File marker 10 may also be used to mark the position of material removed from so-called open-shelf files. In such an application, file marker 10 is inserted in the selected position so that body side edge 15 rests on the shelf which supports the files and top edge 12 projects outward from the files to mark the selected position. If desired, flexible leg portion 16 can be used to engage adjacent file material by slipping the edge of the adjacent file, paper or the like between leg portion 16 and body side edge 14.

Another important aspect of this invention lies in providing a kit of color-coded file markers 10*a*, 10*b*, 10*c* and 10*d* as shown in FIG. 4. File markers 10*a*, 10*b*, 10*c* and 10*d* are respectively shown as being color-coded in red, blue, green, and yellow. Providing the file markers in a color-coded kit of at least two different colors is advantageous since different colored file markers can be provided to different employees in an office for marking the position of removed files. In that way, when a different colored file marker is assigned to each person having access to a file, other personnel looking for a file can tell who has removed a file by the color of the file marker.

The body portion 11, leg portion 16, and an intermediate portion 16 are preferably integrally molded of a polymeric material, such as polypropylene, so the three portions are coplanar and have a relatively uniform thickness t of about 0.0625 to 0.1250 inches. Such a thickness provides a relatively flat file marker for fitting between tightly packed file contents while still providing a file marker with sufficient strength for being inserted between such tightly packed file contents. While molding the file marker of a polymeric material such as polypropylene is believed to be preferred, it will be understood that file marker 10 can be manufactured in many different ways and made of a variety of different materials.

While in the foregoing specification a detailed description of a specific embodiment of the invention was set forth for the purposes of illustration, it will be understood by those skilled in the art that many of the details herein given may be varied considerably without departing from the spirit and scope of the invention.

We claim:

1. A file marker comprising a relatively flat body portion having a pair of body side edges, a depending leg portion having a leg edge in spaced parallel relation to one of said body side edges of said body portion, and an intermediate portion extending between and connecting said one of said pair of body side edges of said body portion and said leg portion, said other of said body side edges consisting of a terminal, substantially straight edge and said leg edge and said one of said pair body side edges defining a gap therebetween adapted to receive a rail of a suspension file drawer.

2. The file marker of claim 1 in which said gap between said leg edge and said body side edge has a width of about 0.125 to 0.3125 inches.

3. The file marker of claim 1 in which said gap between said leg edge and said body side edge has a width of about 0.21875 inches.

4. A file marker comprising a relatively flat body portion having a body side edge, a depending leg portion having a leg edge in spaced parallel relation to said body side edge of said body portion, and an intermediate portion extending between and connecting said body portion and said leg portion, said leg edge and said body side edge defining a gap therebetween adapted to receive a rail of a suspension file drawer, said body side edge also including first and second end portions with said leg portion being positioned adjacent to said first end portion and an elongate projection extending outwardly from said second end portion, said elongate projection having a projection edge parallel to said body side edge and said leg edge.

5. The file marker of claim 4 in which said projection edge extends outwardly beyond said body side edge a distance of about 0.125 inches.

6. A file marker comprising a relatively flat body portion having a body side edge, a depending leg portion having a leg edge in spaced parallel relation to said body side edge of said body portion, and an intermediate portion extending between and connecting said body portion and said leg portion, said leg edge and said body side edge defining a gap therebetween adapted to receive a rail of a suspension file drawer, said body portion also including top and bottom parallel edges which are perpendicular to said leg edge and said body side edge and said body portion having a length between said top and bottom edges of about 4.75 to 5.125 inches.

7. A file marker comprising a relatively flat body portion having a body side edge, a depending leg portion having a leg edge in spaced parallel relation to said body side edge of said body portion, and an intermediate portion extending between and connecting said body portion and said leg portion, said leg edge and said body side edge defining a gap therebetween adapted to receive a rail of a suspension file drawer, said body portion including top and bottom parallel edges which are perpendicular to said leg edge and said body side edge, said intermediate portion including a stop edge extending between said leg edge and said body side edge, and a distance between said stop edge and said top edge of said body portion being about 0.75 to 1.25 inches.

8. The file marker of claim 7 in which the distance between said stop edge and said top edge of said body portion is about 1 inch.

9. The file marker of claim 7 in which said stop edge is arcuate.

10. The file marker of claim 7 in which said leg portion has a terminal end and a distance between said stop edge of said intermediate portion and said terminal end of said leg portion is about 0.5 to 1.5 inches.

11. The file marker of claim 1 in which said body portion, said leg portion, and said intermediate portion are integral.

12. The file marker of claim 1 in which said body portion, said leg portion, and said intermediate portion are integrally molded of a polymeric material.

13. A file marker comprising a relatively flat body portion having a body side edge, a depending leg portion having a leg edge in spaced parallel relation to said body side edge of said body portion, and an intermediate portion extending between and connecting said body portion and said leg portion, said leg edge and said body side edge defining a gap therebetween adapted to receive a rail of a suspension file drawer, said file marker being injection molded of polypropylene.

14. The file marker of claim 1 in which said body portion, said leg portion, and said intermediate portion are coplanar and have a relatively uniform thickness.

15. The file marker of claim 14 in which said uniform thickness is about 0.0625 to 0.1250 inches.

16. A suspension file drawer and file marker combination comprising:

a file drawer having a bottom, front and back panels perpendicular to said bottom, two side panels perpendicular to said bottom, and first and second parallel rails extending between said front and back panels and being spaced above said side panels; and at least one file marker having a body portion with first and second side edges and engaging means extending from only one of said first and second side edges of said body portion for engaging only one of said first and second rails of said file drawer, said one of said first and second rails extending through said engaging means so that said body portion of said at least one file marker is positioned to separate contents within said file drawer.

17. The combination of claim 16 in which said engaging means comprises a depending leg portion having a leg edge in spaced parallel relation to a body side edge of said body portion and an intermediate portion extending between and connecting said body portion and said leg portion, said leg edge and said body side edge defining a gap therebetween with said one of said first and second rails extending through said gap.

18. The combination of claim 17 in which said gap between said leg edge and said body side edge has a width of about 0.125 to 0.3125 inches.

19. The combination of claim 17 in which said body portion includes top and bottom parallel edges which are perpendicular to said leg edge and said body side edge, said intermediate portion includes a stop edge extending between said leg edge and said body side edge and resting on said one of said file rails, and a distance between said stop edge and said top edge of said body portion is about 0.75 to 1.25 inches.

20. The combination of claim 19 in which said stop edge is arcuate.

21. The combination of claim 19 which said leg portion has a terminal end and a distance between said stop edge of said intermediate portion and said terminal end of said leg portion is about 0.5 to 1.5 inches.

22. The file marker of claim 17 in which said body portion, said leg portion, and said intermediate portion are integrally molded of a polymeric material.

23. The file marker of claim 22 in which said polymeric material is polypropylene.

24. The file marker of claim 17 in which said body portion, said leg portion, and said intermediate portion are coplanar and have a relatively uniform thickness of about 0.0625 to 0.1250 inches.

25. A suspension file drawer and file marker combination comprising:

a file drawer having a bottom, front and back panels perpendicular to said bottom, two side panels perpendicular to said bottom, and first and second parallel rails extending between said front and back panels and being spaced above said side panels; and at least one file marker having a body portion and engaging means extending from said body portion and engaging means extending from said body portion for engaging one of said first and second rails of said file drawer, said one of said first and second rails extending through said engaging means so that said body portion of said at least one file marker is positioned to separate contents within said file drawer, said body side edge including first and second end portions and said leg portion being positioned adjacent to said first end portion and an elongate projection extending outwardly from said second end portion, said elongate projection having a projection edge parallel to said body side edge and said leg edge and engaging an inside surface of one of said side panels of said file drawer.

26. The combination of claim 25 in which said projection edge extends beyond said body side edge a distance of about 0.125 inches.

27. The combination of claim 16 in which said body portion includes top and bottom parallel edges, and said body portion has a length between said top and bottom edges of about 4.75 to 5.125 inches.

28. A kit of color-coded file markers comprising a plurality of file markers each having a body portion with first and second side edges and means extending from only one of said first and second side edges of said body portion adapted for engaging a rail of a suspension file drawer, said plurality of file markers including file markers of at least two different colors.

29. The kit of claim 28 in which said engaging means comprises a depending leg portion having a leg edge in spaced parallel relation to a body side edge of said body portion and an intermediate portion extending between and connecting said body portion and said leg portion, said leg edge and said body side edge of said body portion defining a gap therebetween sized to receive said rail of a suspension fill drawer.

30. The kit of claim 29 in which said gap between said leg edge and said body side edge has a width of about 0.125 to 0.3125 inches.

31. The kit of claim 29 in which said body portion, said leg portion, and said intermediate portion are integrally molded of a polymeric material.

32. The kit of claim 31 in which said polymeric material is polypropylene.

33. The kit of claim 29 in which said at least two different colors of said file markers includes four different colors.

34. The kit of claim 33 in which said four different colors comprise the colors of red, green, blue and yellow.

35. A kit of color-coded file markers comprising a plurality of file markers each having a body portion and means extending from said body portion adapted for engaging a rail of a suspension file drawer, said plurality of file markers including file markers of at least two different colors, said body side edge including first and second end portions and said leg portion being positioned adjacent to said first end portion and an elongate projection extending outwardly from said second end portion, said elongate projection having a projection edge parallel to said body side edge and said leg edge.

36. The kit of claim 35 in which said projection edge extends beyond said body side edge a distance of about 0.125 inches.

37. The kit of claim 28 in which said body portion includes top and bottom parallel edges, and said body portion has a length between said top and bottom edges of about 4.75 to 5.125 inches.

38. The kit of claim 28 in which said body portion, said leg portion, and said intermediate portion are coplanar and have a relatively uniform thickness of about 0.0625 to 0.1250 inches.

* * * * *